US007896364B1

(12) United States Patent
Ferreira

(10) Patent No.: US 7,896,364 B1
(45) Date of Patent: Mar. 1, 2011

(54) INCREASED TILT ROLLER WHEEL ASSEMBLY

(76) Inventor: Americo D. Ferreira, Hampton Bays, NY (US)

( * ) Notice: Subject to any disclaimer, the term of this patent is extended or adjusted under 35 U.S.C. 154(b) by 232 days.

(21) Appl. No.: 12/114,749

(22) Filed: May 3, 2008

Related U.S. Application Data

(60) Provisional application No. 60/928,016, filed on May 7, 2007.

(51) Int. Cl.
*A63C 17/02* (2006.01)

(52) U.S. Cl. ..... 280/11.27; 280/11.28; 280/87.03

(58) Field of Classification Search ..... 280/11.27, 280/11.28, 87.03, 87.042, 11.223
See application file for complete search history.

(56) References Cited

U.S. PATENT DOCUMENTS

| | | | | | |
|---|---|---|---|---|---|
| 921,102 | A * | 5/1909 | Grout | 280/11.28 |
| 1,018,512 | A * | 2/1912 | Mees | 280/11.28 |
| 1,034,625 | A * | 8/1912 | Kohler et al. | 280/11.19 |
| 1,935,187 | A * | 11/1933 | Kitselman | 280/11.28 |
| 2,126,359 | A * | 8/1938 | Vogt | 280/11.28 |
| 3,023,022 | A * | 2/1962 | Boyden | 280/87.042 |
| 3,331,612 | A * | 7/1967 | Tietge | 280/11.28 |
| 3,399,904 | A | 9/1968 | Schinke | |
| 3,630,540 | A | 12/1971 | Smith | |
| 4,071,256 | A * | 1/1978 | Kimmell | 280/11.28 |
| 4,095,817 | A | 6/1978 | Cohen | |
| 4,109,925 | A * | 8/1978 | Williams et al. | 280/11.28 |
| 4,152,001 | A * | 5/1979 | Christianson | 280/11.28 |
| 4,245,848 | A * | 1/1981 | Dudouyt | 280/11.28 |
| 4,251,087 | A * | 2/1981 | Hansen | 280/11.28 |
| 4,596,396 | A * | 6/1986 | Merbler | 280/11.28 |
| 4,795,181 | A | 1/1989 | Armstrong | |
| 5,263,725 | A * | 11/1993 | Gesmer et al. | 280/11.28 |
| 5,794,955 | A * | 8/1998 | Flynn | 280/87.042 |
| 5,839,737 | A | 11/1998 | Kruczek | |
| 5,997,018 | A * | 12/1999 | Lee | 280/87.042 |
| 6,193,249 | B1 * | 2/2001 | Buscaglia | 280/87.042 |
| 6,386,562 | B1 | 5/2002 | Kuo | |
| 6,616,155 | B2 * | 9/2003 | Tuan | 280/87.041 |
| 7,070,193 | B2 | 7/2006 | Yamaguchi | |
| 7,093,842 | B2 | 8/2006 | Chmelar | |
| 7,159,879 | B2 | 1/2007 | Cole | |

(Continued)

FOREIGN PATENT DOCUMENTS

CA 2413648 A1 6/2003

(Continued)

*Primary Examiner*—Jeffrey J Restifo
(74) *Attorney, Agent, or Firm*—Island Patent; F. Scott Tierno

(57) ABSTRACT

A roller wheel assembly includes a support member, a bearing-based rotatable coupling, and a wheeled support structure having two rollably coupled, spaced, and axially aligned roller wheels. The support member includes a first upper portion, and a second downwardly angled portion, with the downwardly angled portion having a through-bore proximate to a lower end. The wheeled support structure is rotatably coupled to the downwardly angled portion of the support member such that a side-to-side tilting of the upper portion of the support member, with respect to a ground surface, provides an enhanced and sharp turning capability. This abstract is provided to comply with rules requiring an abstract, and is submitted with the intention that it will not be used to interpret or limit the scope and meaning of the claims.

17 Claims, 12 Drawing Sheets

U.S. PATENT DOCUMENTS

| | | | | |
|---|---|---|---|---|
| 7,172,044 | B2 | 2/2007 | Bouvet | |
| 7,243,925 | B2 * | 7/2007 | Lukoszek | 280/11.28 |
| 7,316,408 | B2 * | 1/2008 | McClain | 280/87.042 |
| 2004/0021281 | A1 | 2/2004 | Stephens, Jr. | |
| 2007/0001414 | A1 | 1/2007 | Kang | |
| 2009/0166993 | A1 * | 7/2009 | Jackman et al. | 280/87.042 |

FOREIGN PATENT DOCUMENTS

| | | | |
|---|---|---|---|
| CA | 2524490 | A1 | 11/2003 |
| EP | 0558766 | A1 | 9/1993 |

* cited by examiner

INCREASED TILT ROLLER WHEEL ASSEMBLY

CROSS REFERENCE TO RELATED APPLICATION

The subject matter contained herein claims priority from the commonly owned U.S. provisional patent application Ser. No. 60/928,016 filed on May 7, 2007, which is hereby incorporated by reference.

TECHNICAL FIELD

The presently disclosed invention relates most generally to roller wheel assemblies and structures for use with items such as skateboards, roller skates, etc. More particularly, the present invention relates to improved capability roller wheel assemblies, providing a simplified, strong, and highly tiltable arrangement, having increased and very fluid turning and steering capabilities.

BACKGROUND

This section provides a concise introduction to the available prior art, and associated motivations for a plurality of the presently disclosed features of the claimed invention. The art discussed herein is not to be considered admitted prior art, and is presented as a starting point to attempt to more clearly discuss and describe important features and structures of the roller wheel assembly of the present invention.

The prior art provides a number of examples of roller wheel assemblies, which are often termed "wheel trucks" or simply "trucks". For example, a conventional skateboard is typically constructed using two trucks, with a first at the front end of a foot contacting board, and a second at the rear end. Importantly, due to several considerations, most commercial and stunt skateboards are intentionally structured with stiff and only slightly tiltable roller wheel assemblies (e.g., trucks). A first category of motivation for employing stiff (minimal tilting) trucks is related to stability and efficiency. That is, the use of stiff trucks results in a more stable and efficient forward motion, with more energy directed to forward rolling speed. In addition, when jumping and landing, as some skateboard users do, the stiffer trucks are helpful when elevating and safely landing.

A second issue that one encounters with most common skateboards, is the desire for a low riding construction, with the foot contacting member(s) relatively close to the ground. As a result, if the trucks of these skateboards were relaxed (e.g., not as stiff, and more tiltable), the tops of the roller wheels would likely contact a bottom surface of the foot contacting (top) member, typically a somewhat flattened board or board-like construction.

Importantly, and as understood by skilled persons, the available and known stiff roller wheels assemblies of the prior art clearly, and by design, result in an inability of an individual to utilize certain body motions for causing a somewhat sharp zigzagging. With the user as an energy source, such zigzagging motions may be employed to 'propel' the skateboard along a ground surface that is level or having a modest incline. In contrast, when a typical individual is observed using a conventional (stiff) skateboard, and the individual comes to any type of inclined grade, they will often employ an arrangement wherein one foot is left on the top surface of the skateboard while the individual's second foot is employed for repeatedly contacting and pushing off on a ground surface, thereby propelling the skateboard up the grade. This pushing-off activity is employed at regular intervals, until enough speed is attained, or alternately a level or downhill grade is encountered.

When considering the present invention, and in contrast to the known prior art, when roller wheel assemblies are employed that are specifically structured for a greater tilting (e.g., up to 40 to 50 degrees), an individual may employ a self-propelling zigzagging activity. As will be seen, the provided increased tilting capability (say up to 40 degrees), and its inherent easy and fluid motion, enables the required tighter, sharper, and rapidly alterable turning capability needed for such zigzagging. This may be termed an "enhanced tilting and steering capability", in accordance with the invention. When observed in use, the enhanced, increased, and readily controllable tilting and steering, leads to an activity that is more akin to snowboarding, than it is to skateboarding. This is due to the significantly increased back and forth (zigzagging) motion that is employable during use. This fully supported back and forth propulsion method is also an excellent form of aerobic exercise.

The prior art does provide examples of more tiltable roller wheel assemblies. However, those found have inadequate structures that are not practical for long term, heavy duty use. In addition, these known arrangements and structures are substantially fixed, lacking the configurable and adjustable features of the present invention. Accordingly, these structures may be adequate for children's devices and light duty usage, but are not durable and capable of heavy practical use, say by teenagers and fully grown individuals.

As such, and as appreciated by skilled persons, there is a need to provide improved and more durable roller wheel assemblies that are simple in structure, and arranged to enable ready and increased tilting, and (thereby) enhanced steering, turning, and zigzagging capabilities, while also providing a very strong, long life, and easy to manufacture structure. A number of other characteristics, advantages, and or associated novel features of the present invention, will become clear from the description and figures provided herein. Attention is called to the fact, however, that the drawings are illustrative only. In particular, the embodiments included and described, have been chosen in order to best explain the principles, features, and characteristics of the invention, and its practical application, to thereby enable skilled persons to best utilize the invention and a wide variety of embodiments providable that are based on these principles, features, and characteristics. Accordingly, all equivalent variations possible are contemplated as being part of the invention, limited only by the scope of the appended claims.

SUMMARY OF PREFERRED EMBODIMENTS

In accordance with the present invention, a roller wheel assembly is comprised of a simple, durable, and easily serviced construction, which provides ready and easy tilting. Even when structures are provided for a light biasing of the assembly to a centered and substantially straight rolling position, the structures of the invention clearly support an increased steering and turning capability—especially when compared to common roller wheel assemblies such as found on the well known and ubiquitous single-board dual-truck skateboards. Preferred embodiments of the presently taught roller wheel assemblies of the invention include a support member, a rotatable coupling that is preferably bearing-based, and a wheeled support structure having two rollably coupled, spaced and axially aligned roller wheels.

The support member includes a first upper portion, which may actually be fastened to, or integrated into, other included structures, such as a flattened center member proving a top foot contacting area. The support member also includes a second downwardly angled portion. The downwardly angled portion is preferably considerably thinner than it is wide, preferably forming a plane or surface, and is provided having a through-bore. Importantly, a preferred 'downward angle' of the downwardly angled portion of the support member, with respect to a providable first upper portion, may be understood to be in the range of 30 degrees to 60 degrees. Other more preferred ranges and selected angles will be discussed hereinafter.

The roller wheel assembly further includes a roller wheel support structure having at least two roller wheels rollably coupled thereto. Preferred roller wheel support structures will include a substantially transverse wall portion or member, and at least two spaced side walls. Each side wall is substantially orthogonally and rigidly coupled proximate to one of the ends of the transverse wall. Accordingly, the preferred roller wheel support structure may be provided as a 3-walled somewhat U-shaped structure, or more preferably as a very rigid easy to manufacture 4-walled rectangular structure, as will be depicted in the figures and discussed in the detailed description. The roller wheel support structure may be cast, machined, and or formed by bending and or cutting raw materials (e.g., plates, sheets, rectangular conduits/tubings, etc.).

The transverse wall of the roller wheel support structure also includes a bore (hole) located proximate to a center location. The bore of the transverse wall is preferably provided as a threaded hole. The threaded hole is employed, along with the through-bore of the downwardly angled portion, as a portion of a steering related bearing-based rotatable coupling. It may be noted that the threaded hole may equivalently be termed a 'threaded-bore'. Preferred embodiments of the bearing-based rotatable coupling may include one or more axially aligned bearings, as is depicted in the figures. In a most preferred arrangement, at least two axially aligned bearings are included with each bearing located on an opposing side of the preferably flattened downwardly angled portion of the support member (and axially aligned with the above discussed threaded-bore and through-bore). An axis of rotation for the bearing-based rotatable coupling is established by a capped center shaft that passes through each bore, a center of each included bearing, and is capped at each end of the included center shaft. The center shaft, which may be provided by a basic threaded bolt, establishes what may be termed a "steering related axis of rotation of the bearing-based rotatable coupling".

As may be understood by skilled persons, the use of a rotatable coupling for coupling the downwardly angled portion of the support member to the roller wheel support structures, which are taught herein, yields a structure and arrangement such that a side-to-side tilting of the upper portion of the support member, with respect to a ground surface, provides ready and easily effected steering and a sharp turning capability. For example, the present invention's structure will support motion such as sharp zigzagging (equivalent to a motion used in snowboarding), and a rapid tacking back and forth. The increased and very smooth tilting provides for the enhanced steering capability of the invention. The term enhanced tilting and steering capability is to be understood to include a tilting capability wherein the upper portion of the support portion (e.g., FIGS. 6B and 6C) is tilted upwards of 45 degrees, +/−5 to 10 degrees, or so. Importantly, the present structure of the invention supports such tilting, resulting in very sharp turning, with typical minimal turning radius of 1 to 2 feet (with max tilting), while keeping all included roller wheels firmly contacting the ground. The traction provided by the present roller wheel assembly, when considering the enhanced tilting and steering capabilities, is notable.

Most preferred roller wheel support structures will be provided for establishing a common or effective rolling axle or axis for each included pair of spaced roller wheels. Examples of simple arrangements will be provided wherein a roller wheel may be fixed to a side wall of the roller wheel support structure in an adjustable fashion. Further, a most preferred bearing-based rotatable coupling of the invention will enable a user to selectably rotate, by 180 degrees, the roller wheel support structure, for placing the roller wheel assembly in one of either a first low rolling position or a second high rolling position. The first low rolling position provides for a lower and more stable operation—best used for new/unskilled users. The second high rolling position raises each included support member, along with structures coupled or fixed to the upper support portion.

Another novel feature of the present roller wheel assembly includes an adjustment arrangement wherein the rolling axis of paired roller wheels may be adjusted. For example, one contemplated arrangement provides for a plurality of spaced and preferably substantially aligned mounting holes being provided upon the side walls of the roller wheel support structure. Further, the adjusting will move the rolling axis either up and down (upon the side walls), or forward and back, based on whether the roller wheel support structure is in the first low rolling position or the second high rolling position. A most preferred adjustment structure provides for a series of spaced and threaded holes to be provided. The threaded holes may be substantially aligned (as depicted) or provided in a more staggered pattern.

It is contemplated that the roller wheel assembly of the invention may most preferably be provided in at least pairs, with one roller wheel assembly provided proximate to end locations of what may be termed a "roller wheel platform". Accordingly, by way of a number of arrangements (as will be fully discussed), the upper support portions of included roller wheel assemblies will be substantially rigidly coupled in an opposing (180 degree rotated) mounting arrangement. This rigid coupling may be provided in many forms, including bolted (FIG. 1), welded, monolithic (1-piece) structures (FIG. 4), and fully integrated monolithic (FIG. 11).

BRIEF DESCRIPTION OF THE DRAWINGS

In the drawings, like elements are assigned like reference numerals. The drawings are not necessarily to scale, with the emphasis instead placed upon the principles and features of the present invention. Additionally, each of the embodiments depicted are but one of a number of possible arrangements utilizing the fundamental concepts of the present invention. The drawings are briefly described as follows:

FIG. 7B also additionally illustrates the even greater steerability of the roller wheel assemblies of the invention in this 'high-riding' or 'high-rolling' configuration.

Figure 1:
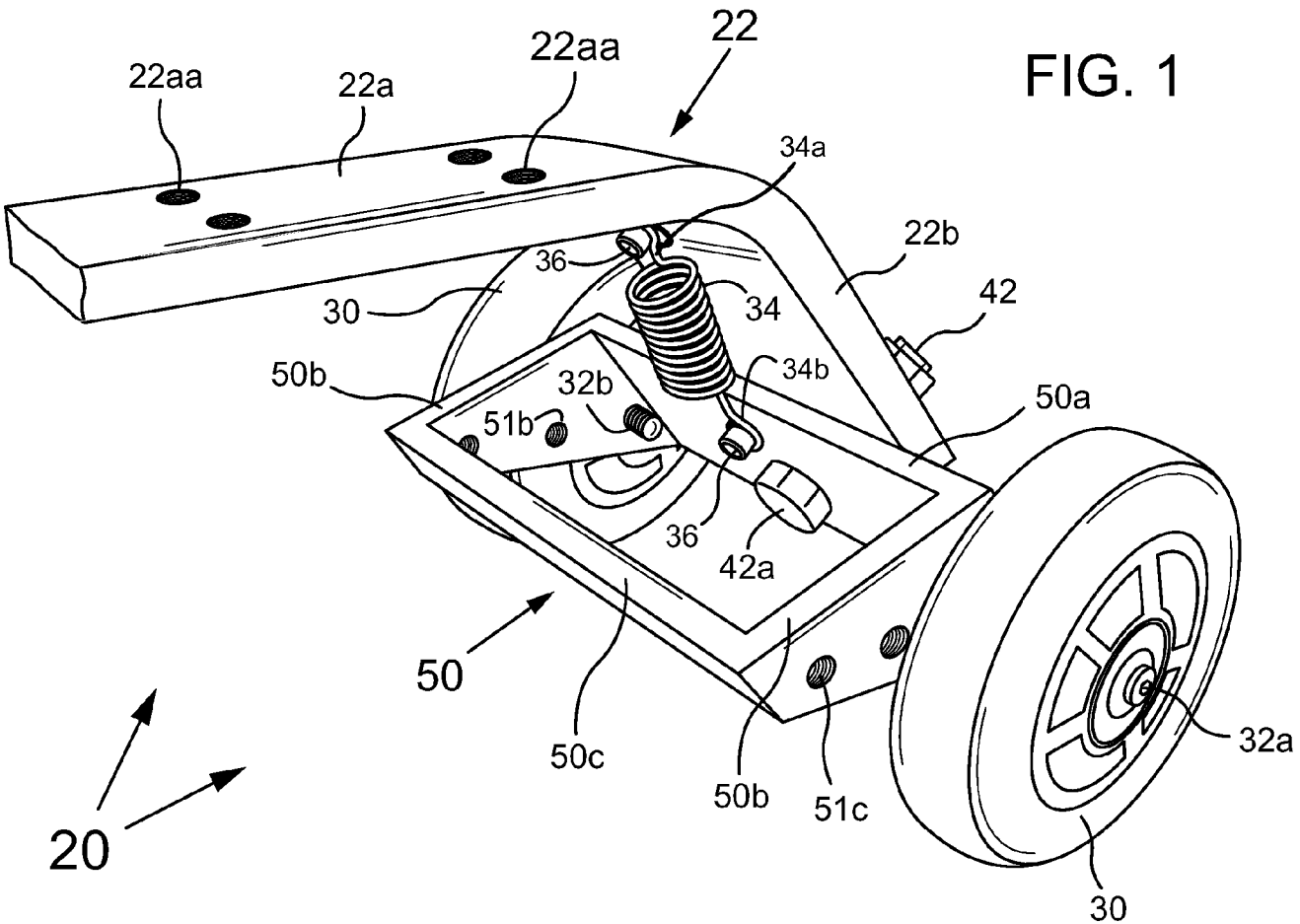
FIG. 1 depicts an elevated perspective view of a first single-ended embodiment of a roller wheel assembly in accordance with the present invention.

| Partial List Of Reference Numerals | |
|---|---|
| 20 | roller wheel assembly |
| 20a | a first roller wheel assembly |
| 20b | a second roller wheel assembly |
| 22 | support member |
| 22a | first upper portion of 22 |
| 22aa | mounting holes |
| 22b | second downwardly angled portion of 22 |
| 22bb | end portion of 22b |
| 23 | through-bore |
| 24 | bearing seat (fixed spacer) |
| 26a, 26b | (opposing) counter bores |
| 28 | (tilt or steering) stop post |

-continued

| Partial List Of Reference Numerals | |
|---|---|
| 30 | roller wheel |
| 32 | axle bolt of 30 |
| 32a | axle bolt head of 32 |
| 32b | threaded end of 32 |
| 34 | bias return spring |
| 34a | first end of 34 |
| 34b | second end of 34 |
| 36 | fixing bolt of 34 |
| 40 | bearing-based rotatable coupling |
| 42 | bolt |
| 42a | bolt head |
| 42b | bolt end |
| 44 | securing nut |
| 46 | spacer |
| 48 | bearing |
| 50 | roller wheel support structure |
| 50a | first transverse wall of 50 |
| 50b | side wall of 50 |
| 50c | (optional) second transverse wall |
| 51a, 51b, 51c | mounting holes in 50b |
| 53 | threaded-bore |
| 58b | second steering stop post |
| 60 | friction brake |
| 62 | ground contacting braking portion |
| 66 | brake mounting bracket |
| 66a | first bracket portion |
| 66b | second bracket portion |
| 70 | (center) coupling or coupling structure |
| 80 | roller wheel platform (simple) |
| 80a | first or front end of 80 |
| 80b | second or rear end of 80 |
| 90 | foot contacting member |
| 90-1 | boot embodiment |
| 100 | ground surface |
| A | downward angle |
| R | (steering) axle or axis of rotation |
| P | plane passing through 22b |

DETAILED DESCRIPTION OF EMBODIMENTS OF THE INVENTION

It is important to establish the definition of a number of descriptive terms and expressions that will be used throughout this disclosure. The term 'enhanced tilting and steering capability' is to be understood to include a tilting capability wherein the upper portion of the support portion (see FIGS. 6B and 6C) has tilting capability, based on the specific embodiment, in a preferred range of 40 to 50 degrees. The term 'tilting' may be understood to mean or indicate that one side or edge of included upper portions of the support member is higher or above an opposite side or edge. A most preferred range would support tilting (to either side) of 40 to 50 degrees. A most preferred tilting angle would be substantially 45 degrees. Importantly, the present structure of the invention supports these ranges of tilting, resulting in a very sharp and controlled turning capability. Specifically, the embodiment of the present roller wheel assembly will readily support a typical minimal turning radius of 1 to 2 feet (realized by employing a maximum or near maximum tilting angle). It may also be noted that the enhanced tilting and steering capability of the present invention permits such steep tilting angles, while fully maintaining all (pairs of) roller wheels in firm contact with the ground surface upon which the roller wheel assembly or assemblies of the invention are in rolling contact. This results in increased traction not readily seen with the common and ubiquitous skateboards commonly in use today. The term 'substantially' will be employed as a modifier to indicate exactly or close to the given feature, structure, or characteristic. For example, the phrase 'a tilting angle of substantially 45 degrees' may indicate the tilting angle is exactly 45 degrees or equivalently close to 45 degree (e.g., +/−degrees from true/exact 45 degrees). Similarly, the term 'substantially parallel' as employed herein will describe a relationship wherein two members, items, or portions may be exactly parallel, or alternately somewhat close to parallel. As such, substantially parallel items may actually be up to +/−5 to degrees or so from a truly parallel arrangement, and still be correctly considered 'substantially parallel' within the present disclosure. As such, the terms 'substantially parallel' and 'roughly parallel' may be considered equivalents. In like fashion, the terms 'substantially orthogonal', 'substantially orthogonally oriented', etc., can be assumed to mean that the members may be exactly fixed or rigidly coupled to each other at a true 90 degree angle, or alternately somewhat close to 90 degrees. As such, substantially orthogonal members may actually be up to +/−5 to 10 degrees or so from a truly orthogonal arrangement, and still be correctly termed substantially orthogonal.

Continuing, the terms 'coupler', 'coupled to', 'coupling', etc., are to be understood to mean that two or more described items are either directly connected together, or alternately, connected to each other via one or more additional, possibly implied or inherent structures or components. For example, when considering the rollable coupling of a roller wheel to a roller wheel support structure, various mechanical components may be included, such as bolts, nuts, locking structures such as cotter pins, locking pins, etc., which may not be explicitly discussed in any significant detail—as these items are well understood by skilled persons. The term 'downwardly angled' as employed when describing and discussing the relationship of the downwardly angled portion of the support member with respect to the upper support portion, is intended to mean that a sharp or possibly gradual angle is provided, causing a downward angling in a possibly preferred range of 30 to 60 degrees. A possibly most preferred downward angle, say of 45 degrees, will therefore indicate that the angle between a plane or surface associated with the upper support portion (of the support member) and a plane or surface of the downwardly angled portion may most preferably be substantially 45 degrees. Other important terms and definitions will be provided, as they are needed, to properly define the present invention and its associated novel characteristics and features. In addition, the terms and expressions employed herein have been selected in an attempt to provide a full and complete description of the invention. These terms may very well have equivalents known to skilled individuals, which may be long established in the art. As such, the terminology employed has been carefully chosen and is intended for illustration and completeness of description, and may very well have equivalents that are known in the art, but not employed here.

Figure 2:
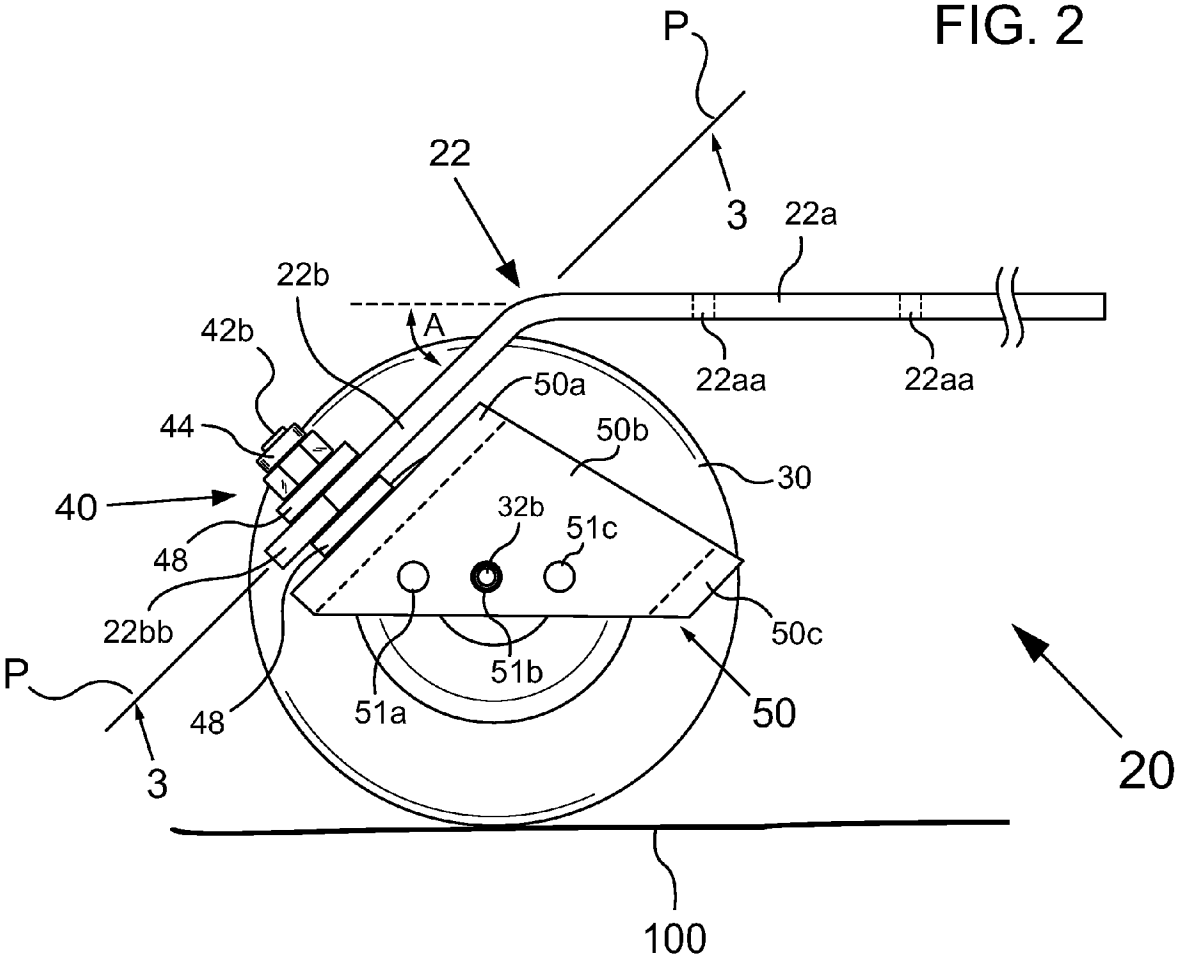
FIG. 2 provides a side view of a roller wheel assembly that is consistent with the embodiment of FIG. 1, and provides additional details of a steering-related bearing-based coupling and a roller wheel support structure, which readily enables increased tilting and steering.

Referring now to the drawings, FIGS. 1 and 2 provide illustrations in the form of an elevated perspective view and a profile/side view, respectively, of a first single-ended embodiment of a roller wheel assembly in accordance with the present invention. As depicted, the roller wheel assembly 20 includes a support member 22, which may be provided as a simple bracket. The support member 22 may include a first upper portion 22*a* and a second downwardly angled portion 22*b*. When provided as an angled bracket, the first upper portion 22*a* may have a length as depicted in FIG. 1. As illustrated, and best seen in FIGS. 7A through 8, the first upper portion 22*a* may be structured for enabling a coupling of the roller wheel assembly to an includable foot contacting top member. For example, as clearly seen in FIGS. 1 and 2, mounting holes 22*aa* may be included to enable a foot contacting member (e.g., a top board) to be fastened to each included roller wheel assembly 20. It may be noted that contemplated includable foot contacting (top) members may be provided as flattened plate-like or board-like structures formed of one or more materials, such as wood, plastic, metal, composites, laminates, etc.

Figure 3:
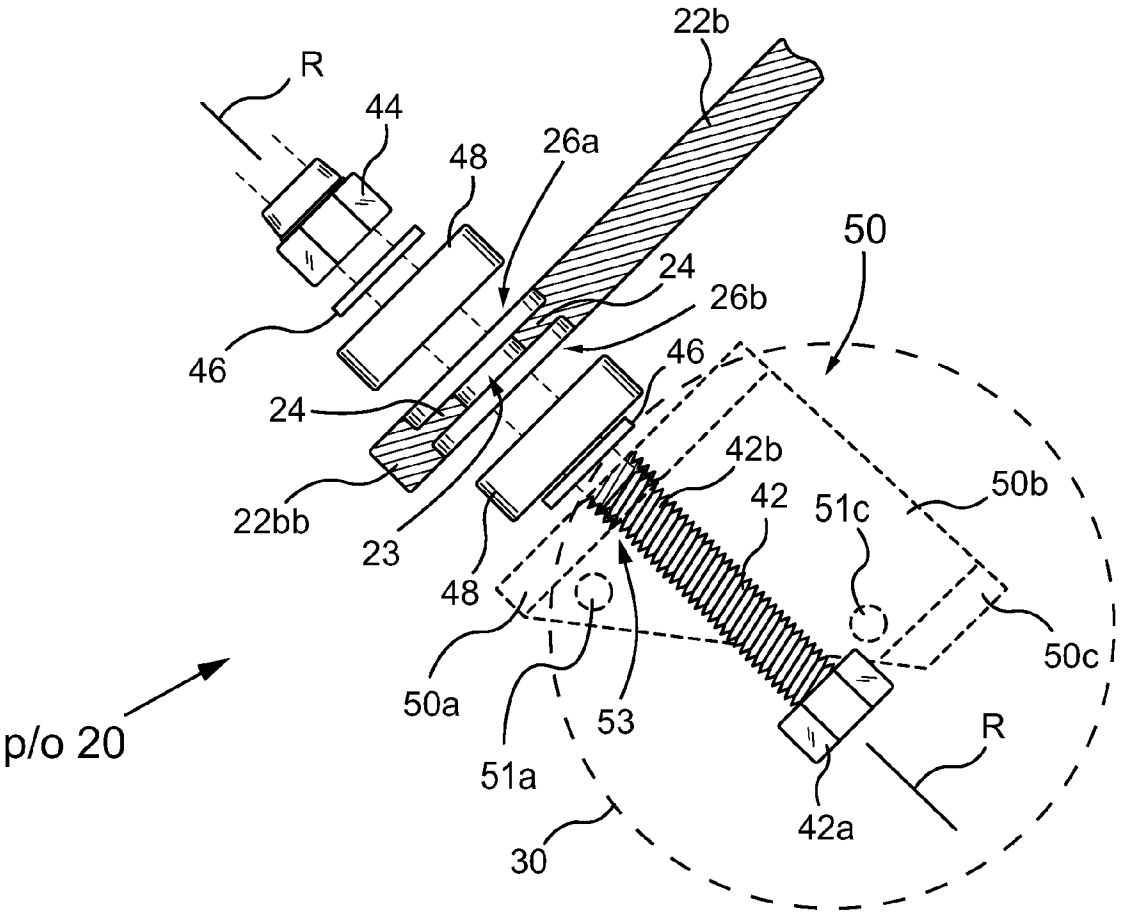
FIG. 3 is an enlarged, partially cut-away, and possibly expanded side view of a downwardly angled (support) portion structured with at least one friction reducing bearing-pair and an associated steering related center shaft, which are portions of a bearing-based rotatable coupling.

Also shown in FIGS. 1 and 2, and possibly best seen in FIG. 3, the downwardly angled portion 22*b* of the support member 22 includes a through-bore 23. The through-bore 23 is included for mechanically establishing a rotational axis of a bearing-based rotatable coupling 40, which is a steering related structure. Importantly, the inclusion of the through-bore 23 in the downwardly angled portion 22*b* establishes an angle for the rotational axis of the bearing-based rotatable coupling 40 of the invention, which is directly related to the downward angle (of the downwardly angled portion 22*b*). This angled arrangement aids in establishing the enhanced side-to-side tilting/steering capability of the first upper portion 22*a*, with respect to a ground surface 100. The ground surface 100 may be provided by any smooth hard surface, including those made of concrete, asphalt, wood, decking material, etc.

It may be noted, as depicted in the figures include herewith, the downwardly angled portion may preferably be considerably thinner than it is wide. For example, a preferred downwardly angled portion 22*b* may be provided by a flattened member, preferably forming or having a plane P passing therethrough. For example, as depicted in FIG. 2, the plane P is shown from an end or side view (with the plane thereby viewable in only two dimensions).

Returning again to FIGS. 1 through 3, a roller wheel support structure 50 is shown rotatably coupled to the downwardly angled portion 22*b* of the support member 22, by way of the bearing-based rotatable coupling 40. The roller wheel support structure 50 preferably includes a first transverse wall 50*a*, and two spaced side walls 50*b*, which may be fixed or formed so as to be substantially orthogonal to the first transverse wall 50*a*. For example, as depicted a first end of each side wall 50*b* may be fixed to the first transverse wall 50*a* one of the opposite end locations of the first transverse wall 50*a*. That is, the first end of a first side wall 50*b* is fixed to a first end of the transverse wall 50*a*, while the first end of a second side wall 50*b* is fixed to a second end of the first transverse wall 50*a*. When so configured the roller wheel support structure 50 may be substantially U-shaped. However, other useful shapes and arrangements are possible. For example, as clearly illustrated in FIGS. 1 through 3, a second transverse wall 50*c* may be provided that is arranged substantially parallel to, and spaced from, the first transverse wall 50*a*. Accordingly, the roller wheel support structure 50, as depicted, may be provided as possibly more rigid 4-walled somewhat rectangular structure.

Regardless of whether the roller wheel support structure 50 is provided as a substantially U-shaped arrangement, a rectangular 4-walled construction, or another equivalent structure, the inclusion of an adjustment means may be provided in preferred embodiments that enables each of the roller wheels 30 to be adjustably fixed to the roller wheel support structure, as determined by the user. For example, as shown in FIGS. 1 and 2, a plurality of spaced and possibly substantially aligned mounting holes, designated 51*a*, 51*b*, and 51*c* (for the embodiments illustrated) may be provided. The spaced mounting holes are preferably located upon the side walls 50*b* of the roller wheel support structure 50. The mounting holes may also be termed roller wheel 'axle receptacles' or 'axle bolt receptacles', and in a simple embodiment are provided by threaded holes passing through the side walls 50*b* of the roller wheel support structure 50. Clearly, the depicted spaced mounting holes 51*a*, 51*b*, and 51*c*, enable and support a front-to-back adjustment capability. For example, as shown in FIG. 1, an included mounting or axle bolt 32 is shown threaded into mounting hole 51*a*—with the end 32*b* shown extending from the opposite side of hole 51*a* of FIG. 1. Therefore a rolling axis (or effective axle) for each roller wheel of FIG. 1 may be arranged for accepting an axle bolt 32 into mounting hole 51*a*. Alternately, as implied in FIG. 2, the rolling axis of the roller wheels 30 may be moved (back) when mounted (screwed) in mounting holes 51*b*. This simple arrangement of a plurality of spaced and possibly aligned mounting holes enables a simple adjusting of the mounting locations and the rolling axis of included roller wheels 30.

As best seen in FIG. 3, one possibly preferred bearing-based rotatable coupling 40 of the roller wheel assembly 20 may include at least two axially aligned bearings 48. The bearings 48 are most preferably located on an opposing side of the flattened downwardly angled portion 22*b* of the support member 22. As depicted, in a most preferred embodiment each bearing 48 is seated within an opposing counter bore 26*a* and 26*b*, respectively. That is, a first counter bore 26*a* is provided on a first side of the downwardly angled portion 22*b*, while a second counter bore 26*b* is provided on a second side of the downwardly angled portion 22*b*. Importantly, the depth of the counter bores 26*a* and 26*b* are such that they collectively form (or leave) a bearing seat 24. The bearing seat 24, which is integral to the downwardly angled portion 22*b* as shown, acts as a seat and support surface for one side of each included bearing 48.

It may be noted that in order to properly seat and support each included bearing 48, the size, depth, etc., of the opposing counter bores will be provided an inner diameter establishing the opening of the through-bore 23 that is both greater than the diameter of the (center shaft) bolt 42 passing therethrough, while also being less than the diameter of the counter bore—so as to suitably establish the bearing seat 24. For example, as illustrated in FIG. 3, the depth of the counter bores 26*a* and 26*b* may be substantially equal to the thickness of the bearing seat 24, or somewhat deeper than depicted.

As shown in FIG. 3, and also depicted in FIGS. 1 and 2, the bearing-based rotatable coupling 40 includes a center shaft. A preferred and simple capped center shaft may be provided by a fully threaded bolt 42 and a mating nut 44. The bolt 42 preferably is threaded into a threaded-bore 53 located proximate to a center location of the transverse wall 50*a*. Once threaded into the threaded-bore 53, and preferably tightened snugly thereto, the extending shaft portion of the bolt may have placed over it, or upon it, a spacer 46 and the first bearing 48. The shaft is then placed into and through the through-bore 23, causing a seating of this first bearing within the counter bore 26*b*, and an extending of the bolt end 42*b* out of the through-bore 23. Next, the second bearing 48 is placed over the bolt 42, followed by a second (upper) spacer 46, and then capped by securing nut 44. See FIGS. 1 to 3. It may be noted that nut 44 is preferably a self locking nut that may be tightened to a snug and very lightly loading tightness (so as to not damage the bearings 48). Once the arrangement of FIG. 3 is fully assembled, as shown in FIGS. 1, 2, and 4, the tilting of the upper support portion 22*a* with respect to ground surface is free and easy, with very low tilting friction resulting from the bearing-based rotatable coupling 40 and the rollable mounting of the roller wheels 30—which will also preferably include friction reducing roller bearings.

It is important to note that the downward angle of the downwardly angled portion 22*b*, directly affects the downward angle of the center shaft (bolt 42) and the associated steering related rotational axis of the bearing-based rotatable coupling 40. As understood by skilled persons, the downward angle A of FIG. 2 represents a complementary angle of the angle of the shaft of the bolt 42. That is, due to the substantially orthogonal mounting of the bolt 42 with respect to both the transverse wall 50*a* and the downwardly angled portion 22*b*, the downward angle A and the angle of the shaft of the bolt when added are therefore substantially 90 degrees (or complementary). As such, if angle A is selected to be 45 degrees, the angle of the center shaft (e.g., of bolt 42) is also 45 degrees. If angle A is substantially 60 degrees, then the center shaft of the bearing-based rotatable coupling 40 is mounted at an angle of substantially 30 degrees. A possibly preferred angle A of the downwardly angled portion 22*b* may be provided in the range of 30 to 60 degrees. A more preferred range for angle A would be 40 to 50 degrees. While a most preferred angle A would typically be substantially 45 degrees. Further, the downward angle A of the downwardly angled portion 22*b* may be assumed to be measured with respect to at least one of the first upper portion 22*a* of the support member 22 or with respect to the ground surface 100 upon which the roller wheel assembly 20 rolls.

Figure 4:
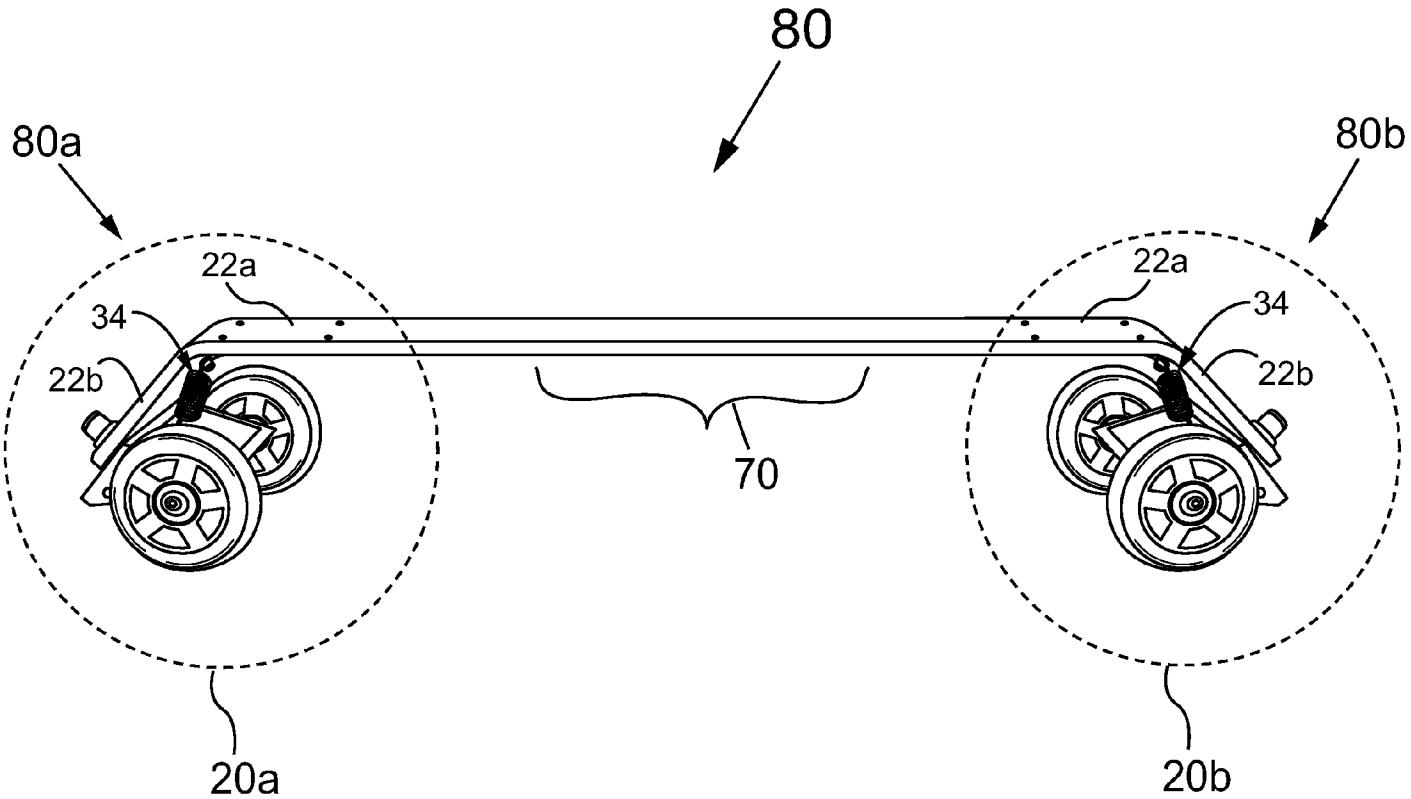
FIG. 4 provides a side view illustrating a pair of opposing and coupled roller wheel assemblies joined by a middle or center coupling portion, and forming what may be termed a roller wheel platform, useful for having affixed thereto foot or feet engaging structures such as a board or suitably flattened surfaces (see FIG. 8), a foot securing boot (see FIGS. 9A-9B), and other possible and providable foot or feet engaging structures.

Turning now to FIG. 4, an embodiment of a roller wheel platform 80 in accordance with the present invention is illustrated in an elevated side view depiction. The roller wheel platform 80 may be formed of two opposing roller wheel assemblies 20 that are coupled by a center coupling 70. This arrangement is also depicted in the conceptualized block diagram of FIG. 5. As illustrated in both FIGS. 4 and 5, the center coupling 70, the upper support portions 22*a*, and the downwardly angled portions 22*b* are each formed of a single monolithic strip of material having two 'end proximate' bends. Alternately, the upper support portions 22*a* may be fastened or fixed to a discrete center support and coupling portion (not explicitly shown), say using a plurality of included mounting holes 22*aa* (of FIGS. 1 and 2).

Figure 5:
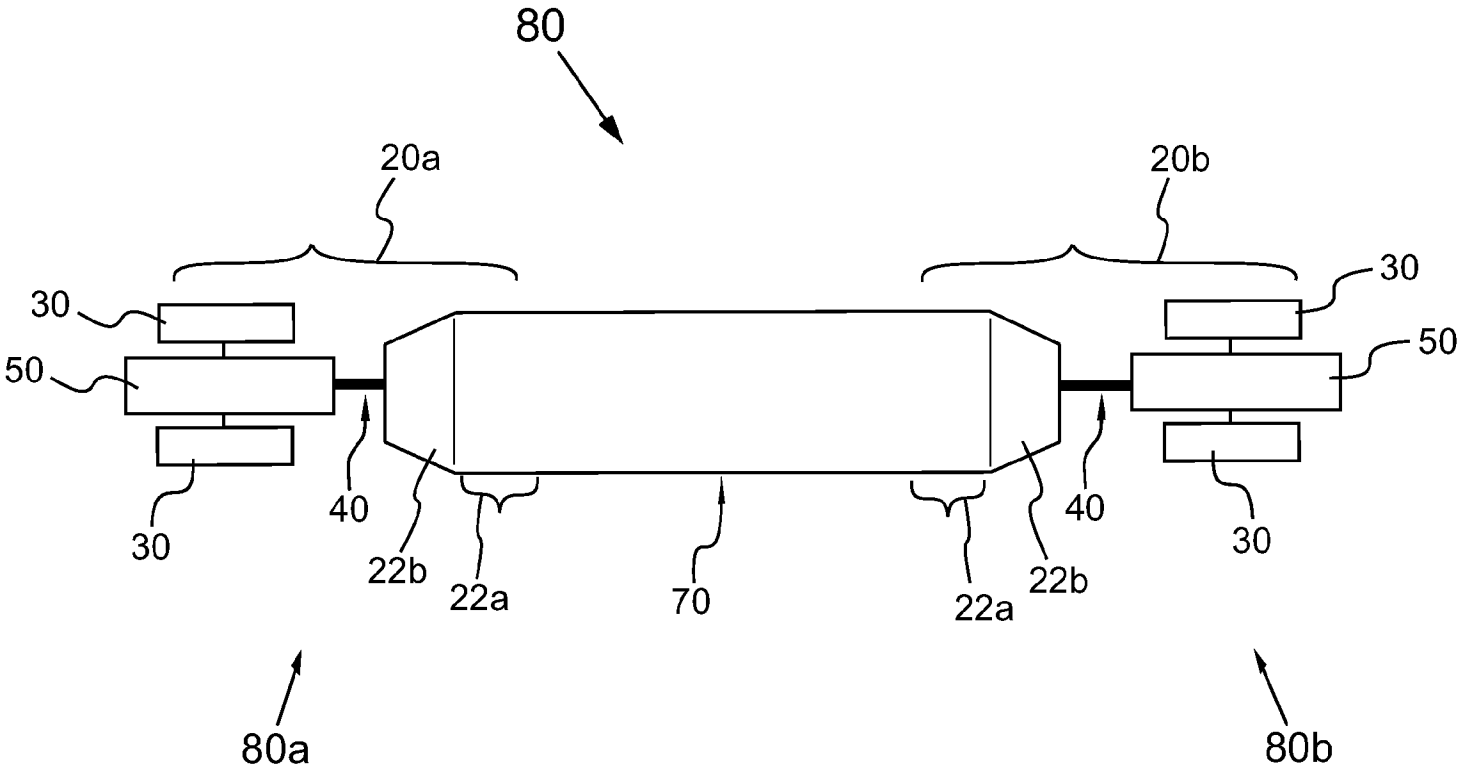
FIG. 5. provides a conceptual high level block diagram of a roller wheel platform of the invention, employing two roller wheel assemblies, with each consistent with the depictions of FIGS. 1 through 4.
Figure 6C:
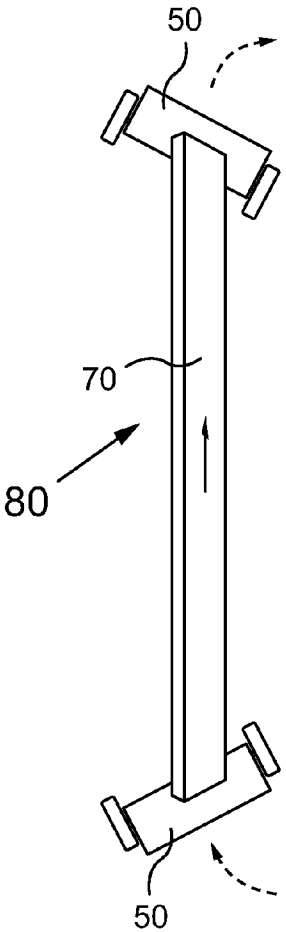
FIGS. 6A, 6B, and 6C depict conceptual embodiments of the invention with double ended roller wheel assemblies coupled by a center coupling portion, shown oriented level for substantially straight-line motion (FIG. 6A), or oriented tilted left for causing motion/movement to the left (FIG. 6B), or oriented tilted right causing motion/movement to the right (FIG. 6C), wherein an actual magnitude of the turning motion produced determined by the tilt angle applied to the center coupling portion.
Figure 6B:
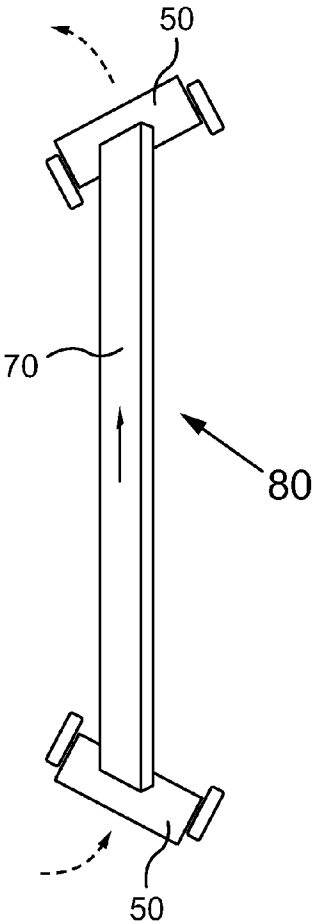
Figure 6A:
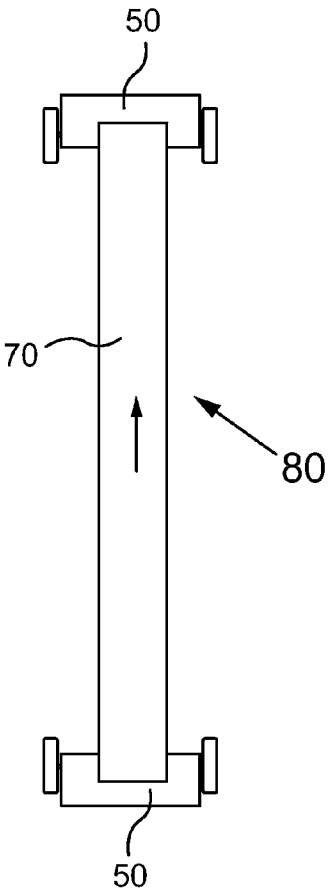
Figure 7A:
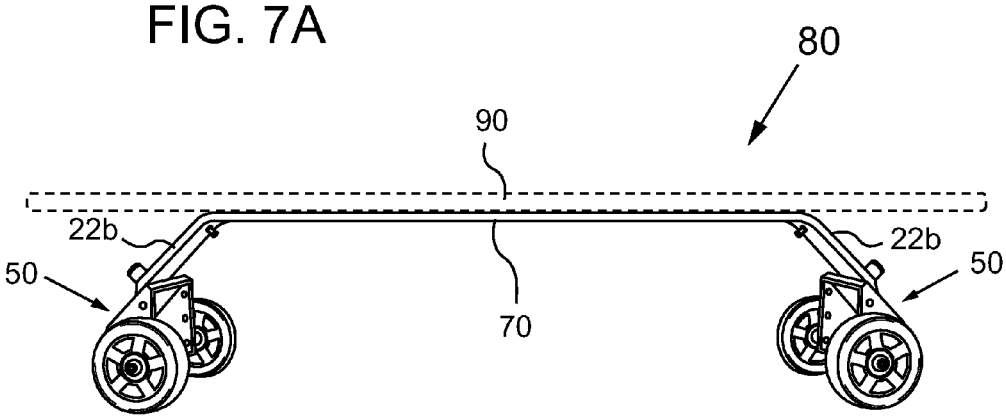
FIGS. 7A and 7B show an embodiment of the invention that is consistent with the roller wheel assembly of FIG. 4, which has been re-configured with the roller wheel assemblies rotated 180 degrees, placing the center coupling portion, the second support portion, and downwardly angled support portions of each roller wheel assembly in an 'elevated position'.
Figure 7B:
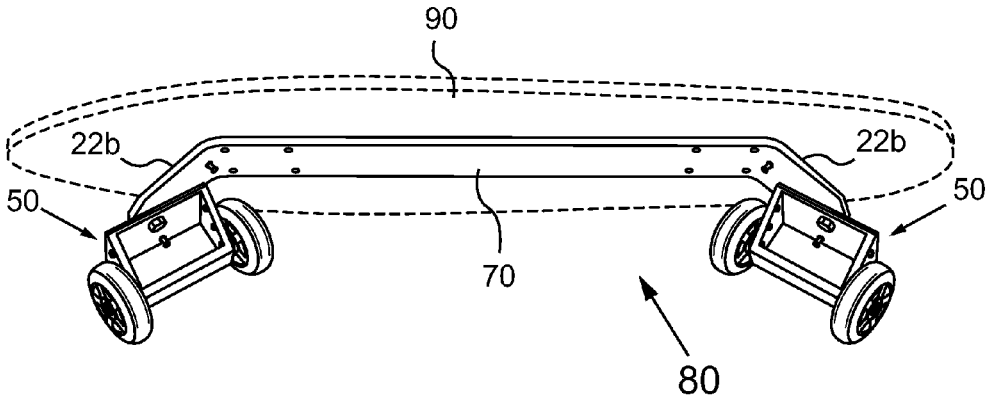
Figure 8:
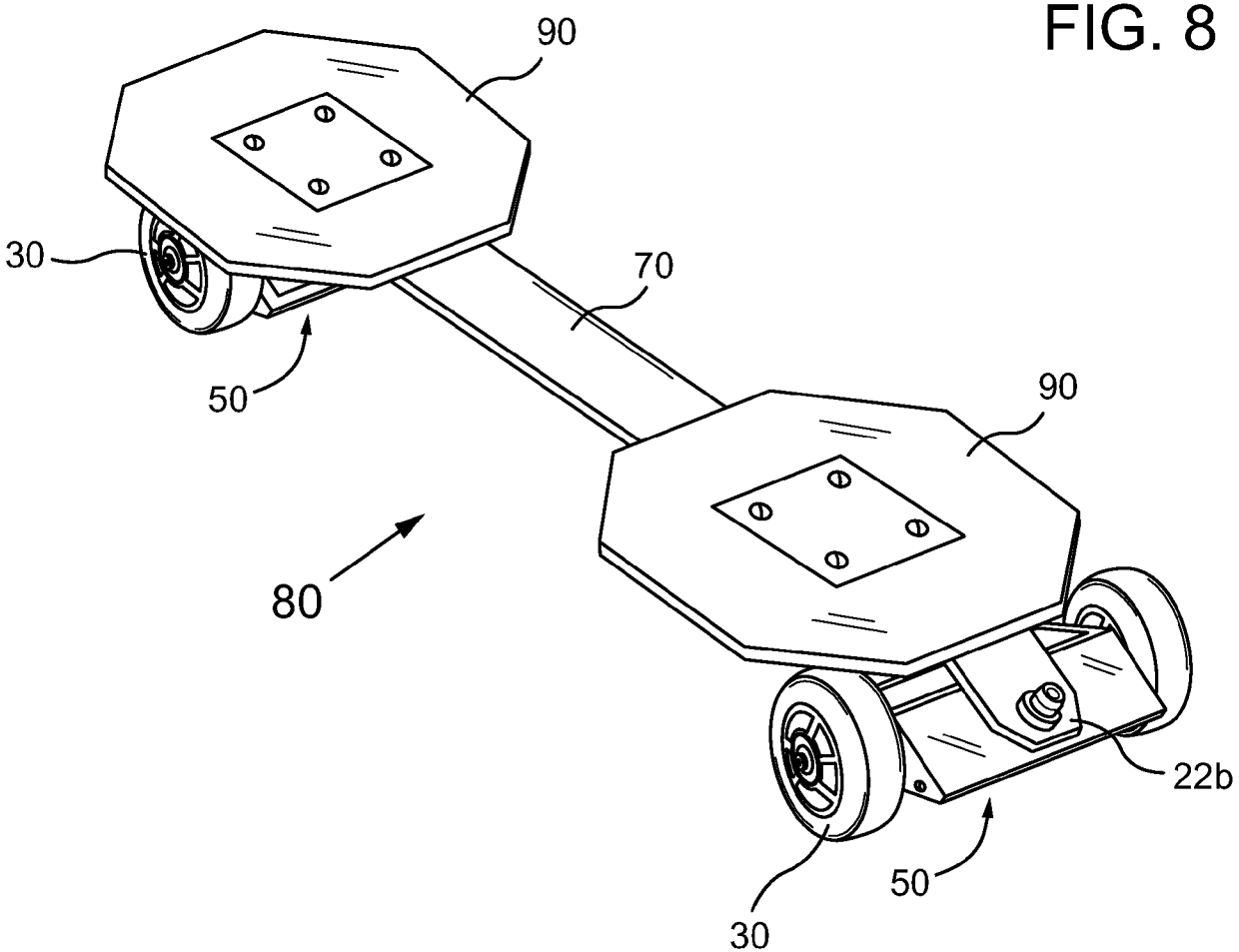
FIG. 8 illustrates an embodiment of a roller wheel board structured using the roller wheel assemblies of the invention, depicted including two separate foot supporting boards or foot contacting pads.

As conceptually depicted in FIG. 5, regardless of how a first roller wheel assembly 20*a* is coupled to the opposing or second roller wheel assembly 20*b*, the integral bearing-based rotatable couplings 40 supports and enables the tilting of the upper support portions 22*a* (and coupling 70) for a very smooth and controlled steering of the roller wheel platform 80. As depicted in FIGS. 6A, 6B, and 6C, a user may control the steering of the roller wheel platform 80 by controlling the tilting or tilt angle of the center coupling 70 (and upper support portions 22*a* fixed thereto). Specifically, if substantially straight line motion is desired a user would attempt to maintain the upper portions 22*a* and any included coupling 70 level, as shown in FIG. 6A. If an individual wants to turn left, the first upper portions 22*a* and coupling 70 would be tilted left, with the left edge of 70 lower than the right edge (as depicted in FIG. 6B). Note that the tilting and associated steering is quite effective as both the front roller wheel assembly and the rear roller wheel assembly each contribute to the turning action. Similarly, if a user wants to turn right, the coupling 70 is tilted right (the right edge lower than the left edge), causing motion/movement to the right (see FIGS. 6C and 7B). Clearly a slight tilting will cause a more gradual turn, while a sharp angled tilting will cause a much sharper turn. Therefore, the actual magnitude of the turning motion produced may be generally considered proportional to and substantially determined by a tilt angle applied to the upper portions and or a center coupling portion, or possibly more correctly by a plane established by these members. For example, a more controlled tilting may be effected fastening one large top foot contacting member 90, as illustrated in FIGS. 7A and 7B. The adding of a one piece top member (FIG. 7A), or separate smaller foot contacting members (FIG. 8), yields an increase in width and area for the contacting of an individual's feet, and directly leads to a more controllable ride.

Returning briefly to FIGS. 2, 7A and 7B, yet another feature of the present roller wheel assembly of the invention will be discussed. As can be seen by contrasting FIG. 2 with FIG. 7A, the bearing-based rotatable coupling 40 and the roller wheel support structure 50 are each structured such that the roller wheel support structure 50 may be rotated 180 degrees. Accordingly, as seen in FIG. 2 a roller wheel assembly 20 may be operated in what may be termed a first 'low rolling position', or equivalently a low riding position. This first (low) rolling position is shown in FIGS. 1, 2, and 4. When in the low rolling position, an included plurality of spaced and substantially aligned mounting holes are arranged to be substantially horizontally spaced—thereby enabling an adjusting of the roller wheel rolling axis/locations in a forward and backward manner, which is equivalent to a front-to-back adjustment capability.

Figure 7C:
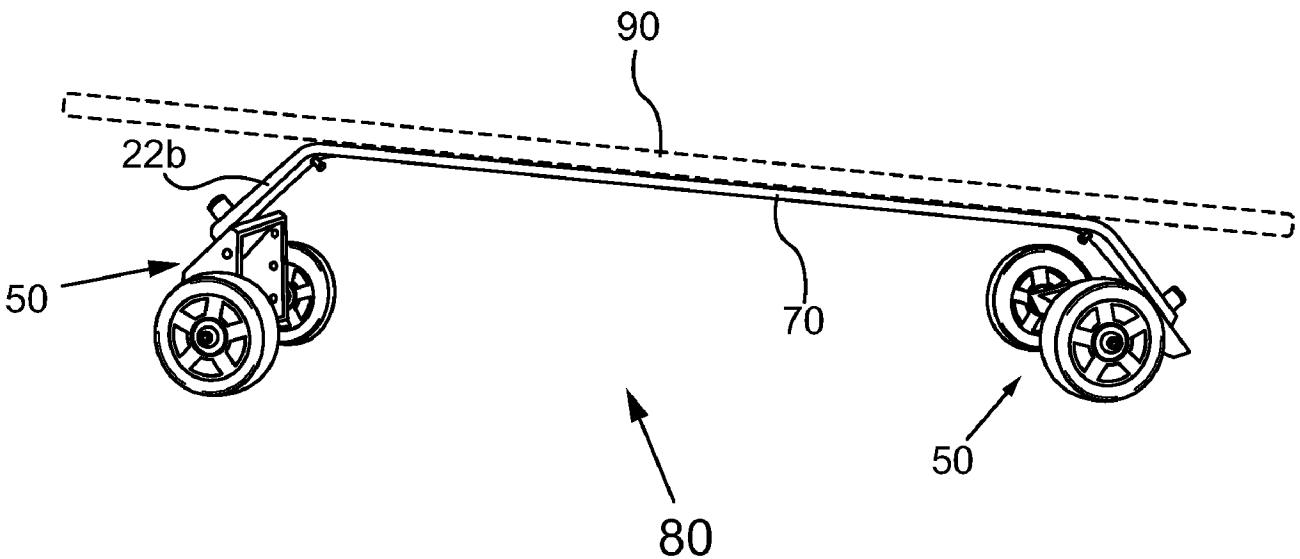
FIG. 7C illustrates yet another operating configuration where only one of the two roller wheel assemblies has been rotated 180 degrees, providing a tilted and possibly more challenging and difficult operating configuration, or one useful on long downhill or uphill stretches.

Similarly, and as depicted in FIGS. 7A, 7B, and 7C, the roller wheel support structure 50 may be rotated 180 degrees about the rotational axis of the bearing-based rotatable coupling 40, placing the roller wheel assembly 20 into a second 'high rolling position', which is also a high riding position. As shown, when in the high rolling position of FIGS. 7A and 7B, the center coupling 70 is now more elevated above the ground surface 100, and the plurality of spaced and substantially aligned mounting holes are now arranged to be substantially vertically spaced, thereby enabling an adjusting of the roller wheel locations in an up and down manner. As possibly understood by skilled persons, there will be an additional degree of difficulty experienced by a user when the roller wheel support structures 50 are each in the second high rolling position. As such, the lowering of the roller wheel assemblies, and the associated roller wheel platform 80, may result in an easier ride with the roller wheels 30 mounted in the mounting holes 51*a* (the front/top most mounting hole). It may be further noted that when in the second high rolling position, a possibly increased tilt angle may be achieved, yielding an even more increased steering and turning ability.

When considering the stability and the clearly enhanced tilting and steering capability of the present roller wheel assemblies of the invention, the steering related axis of rotation 'R', of the bearing-based rotatable coupling 40, which is clearly shown in FIG. 3, is downwardly angled at a preferred downward angle of 45 degrees (as shown in FIGS. 2 and 3). In addition, due to the structure and configuration of each included roller wheel support structure 50, if a mounting hole such as 51*c* is employed, the rolling axis of each roller wheel may be offset or displaced considerably from the plane of the downwardly angled portion 22*b*. More specifically, the roller wheel support structures 50 enable the rolling axis of the roller wheels to be adjusted so that:

a) when in the low rolling position, the wheelbase of the roller wheel platform may be adjusted and altered, enabling an adjusting of the turning radius and steering responsiveness of a roller wheel platform 80; and b) when in the high rolling position, the height of an includable foot contacting member 90 may be altered, possibly altering the difficulty of use and the maximum level of tilt/steering available.

Turning to FIG. 7C, depicted is a roller wheel platform 80 having a first (left) roller wheel assembly 20*a* with the roller wheel support structure 50 configured in the high rolling position, while the second (right) roller wheel assembly 20*b* is arranged with its roller wheel support structure 50 in the low rolling position. The configuration of FIG. 7C, where only one of the two roller wheel assemblies has been rotated 180 degrees, provides a tilted and possibly more challenging and difficult operating configuration. Also, such a mixed configuration may be useful on long downhill stretches, or long uphill stretches.

As seen in FIGS. 1 and 4, a bias return spring 34 may be included with preferred embodiments of the roller wheel assembly 20 of the invention. As depicted, the illustrated embodiments include a bias return spring 34 having a first end 34*a* and a second end 34*b*. Each end 34*a* and 34*b* are further depicted as being fastened, in a somewhat flexible or rotatable fashion using small fixing bolts 36. The bias return spring 34 may be mounted with the first end 34*a* of the bias return spring 34 coupled to the support member 22 and a second end 34*b* of the bias return spring 34 coupled to the transverse wall 50*a* (see FIG. 1). This and equivalent mounting arrangements may be chosen so that the included bias return spring 34 effects a biasing and an aiding in returning the roller wheel support structure 50 to a straight steering position—as depicted in FIGS. 1 and 6A. Equivalently, the bias return springs 34 aid in returning the first upper (support) portions 22*a* to a level and substantially straight steering/rolling position.

Figure 11:
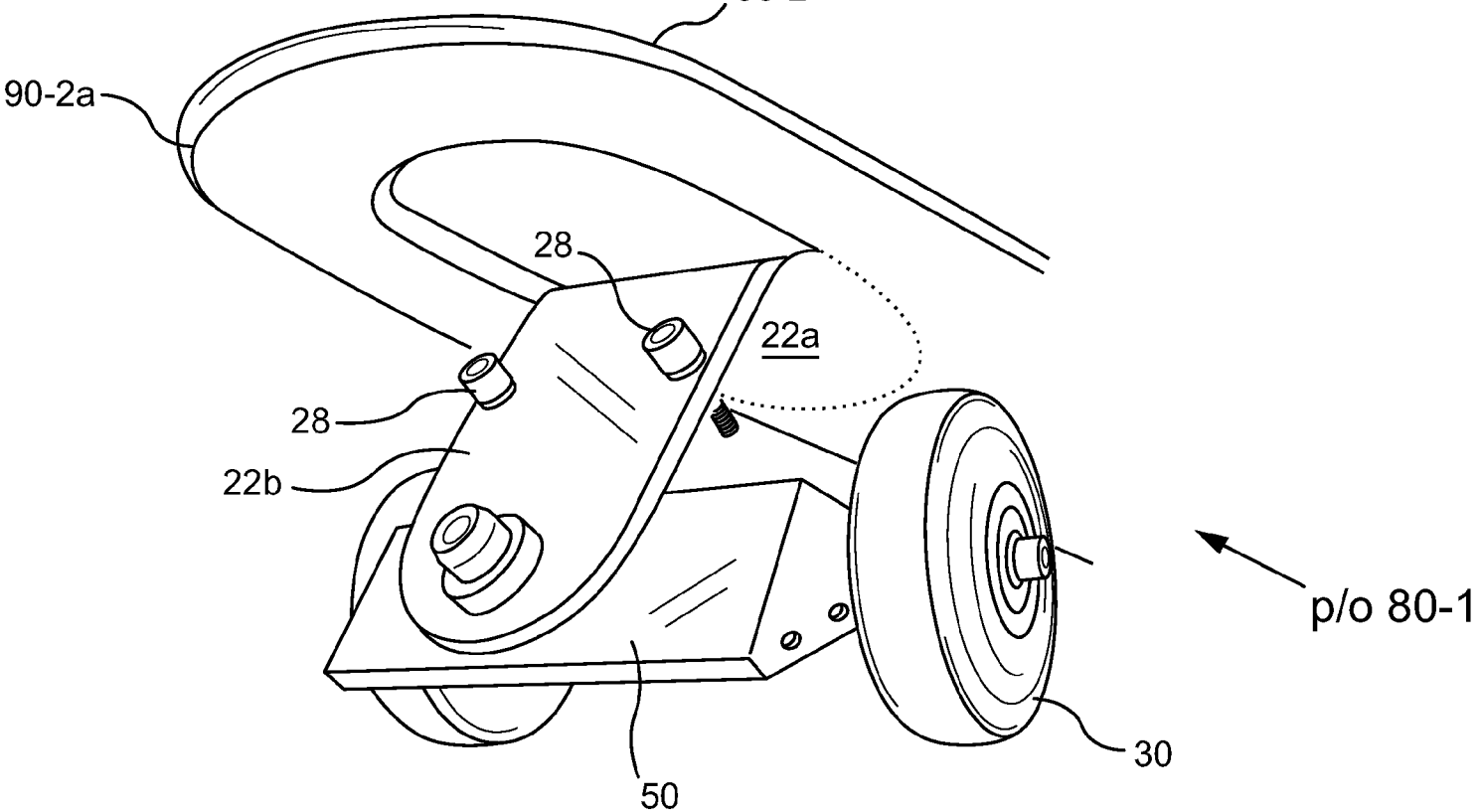
FIG. 11 provides a perspective underside view of one possible modified embodiment of the present invention, which is shown having downwardly angled (support) portions that are formed using opposing downwardly angled portions provided from a curved cut (U-shaped as depicted) made in a bendable and preferably plate material.

Yet another feature of the embodiments of the roller wheel assemblies 20 of the invention is best seen in FIG. 11, as shown a pair of tilt limiting stop posts 28 may be included. Each included stop post 28 may be provided, as shown, by a simple and possibly stubby projection extending outwardly from a read surface of the downwardly angled portion 22*b*. For example, in a most simple arrangement a common threaded screw, possibly with a protective nut or sleeve (not shown) covering the threads. The function of the stop post 28 is to simply limit the tilting of included foot contacting upper portions (e.g., center coupling 70 and a foot contacting member fixed, fastened, or formed therewith), so that the outer rolling surface of the roller wheels 30 does not contact and rub against an under surface of any of these members (at maximum tilting). For example, the stop posts 28 of FIG. 11 are included to prevent the roller wheels 30 from rubbing up against an undersurface of the modified foot contacting member 90-2.

As appreciated by skilled individuals, when features such as the bias return spring 34 of FIG. 1 and the stop posts 28 of FIG. 11 are included, it may be necessary to loosen or remove one of the small fixing bolts 36 and or to back out one or more stop posts 28, to properly effect the 180 degree rotating of the roller wheel support structure 50 (for causing a change from one of the high or low rolling positions).

It must be understood, that the upper support portions 22*a* and included center coupling portions/members of the roller wheel platforms 80 of the invention may be realized using a number of possible approaches and structures. Several are illustrated herein, and will be concisely summarized below. Certainly, other arrangements are possible and providable by skilled persons that have carefully reviewed this disclose. As illustrated in FIG. 2 (implied) and FIG. 4 (explicit) the upper support portion 22*a* may extend and transition into the center coupling 70. Clearly, the fastening (e.g., screwing or bolting) of each included upper support portion 22*a* to a center flattened strip/bar portion is also possible. For example, the embodiment depicted in FIG. 8, may provide for shortened upper support portions 22*a* (blocked from view) that are bolted to each included (octagonal) foot contacting member 90, along with each end of an included center coupling 70. Alternately, the implied shortened upper support portions 22*a* may simply be securely fastened to a common skateboard-type top board (not explicitly shown).

Yet another possible configuration for providing the upper support portions 22*a* of the support members 22, which is truly monolithic in nature, is illustrated in FIG. 11. Illustrated therein is a first end 90-2*a* of a flattened and elongated foot contacting member 90-2, which may be provided having a somewhat traditionally shaped rounded or elliptical plate material. As shown, the foot contacting member 90-2 includes a curved cut provided for enabling a portion of the plate material proximate to (and within) the curved cut to be bent downwardly. This downward angled portion is bent and or fixed at a selected downward angle (e.g. downward angle 'A'), which is most preferably substantially 45 degrees. As such, and as implied by FIG. 11, the curved cut may be substantially U-shaped (as depicted), (preferably soft) V-shaped, of another curved cut wherein a portion of the material is not cut (wherein a bend is provided). As also shown in FIG. 11, a possibly most preferred roller wheel platform 80-1 of the invention may employ an elliptical foot contacting member 90-2 having two spaced, opposingly oriented, and curved cuts, enabling a downward bending of the two portions of plate material within the cuts, thereby forming the two opposing downwardly angled portions 22*a*—one for each includable roller wheel assembly of the roller wheel platform 80-1.

Returning briefly to FIGS. 6B and 7B, it must be understood that the bearing-based rotatable coupling 40 of the present roller wheel assemblies and roller wheel platforms of the invention enable an individual to fully tilt a center coupling 70 and or a top member fixed thereto to cause a very sharp turning (say with a minimal turning radius of 1 to 2 feet), while maintaining each roller wheel fully and substantially in contact with the ground surface. Accordingly, even when a user is fully tilting (e.g., firmly contacting included stop posts 28) an upper foot contacting member, causing a maximum amount of steering and turning supported by the roller wheel assembly, all roller wheels will substantially remain in contact with the ground surface 100 upon which the roller wheel platform is rolling. This greatly reduces lateral slipping and 'sliding out' of one of the front end or rear end of the roller wheel platform.

Figure 9A:
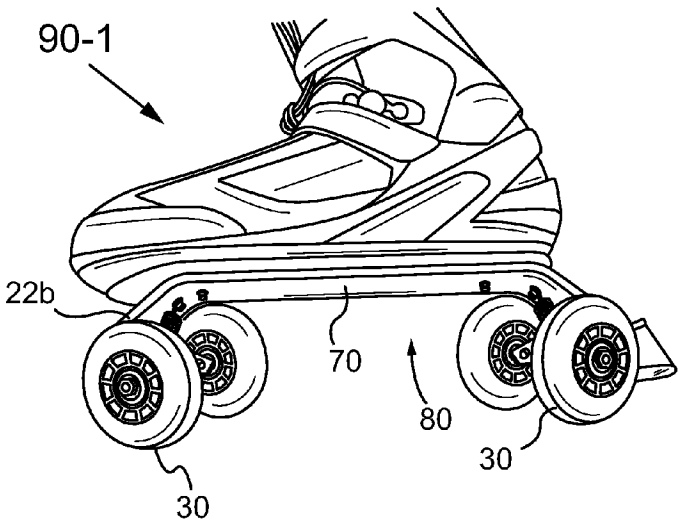
FIGS. 9A and 9B provide a depiction of roller wheel assemblies of the invention employed in a booted roller skate configuration.
Figure 9B:
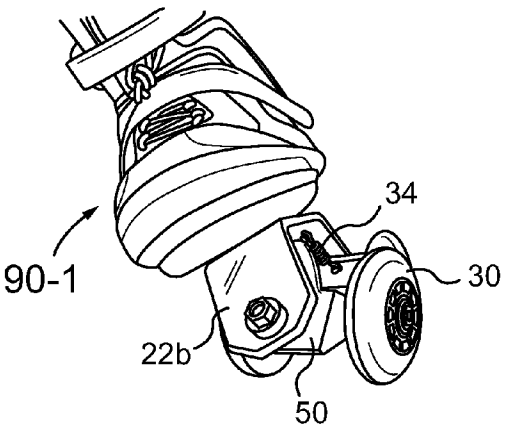

While there have been described herein a plurality of the currently preferred embodiments of the means and methods of the present invention, those skilled in the art will recognize that other and further modifications may be made without departing from the invention. For example, available foot contacting means, instead of the simple flattened structures of FIGS. 7A, 7B, 8, and 11, other foot engaging structures may be employed. For example, considering the boot embodiment 90-1 of FIGS. 9A and 9B, a version of the roller wheel platform of FIG. 4, may be employed with a shorter wheel-base provided by a shorter center coupling 70. In addition, the wheel track (width) of the embodiment of the roller wheel assembly 90-1 may be desirable.

Figure 10:
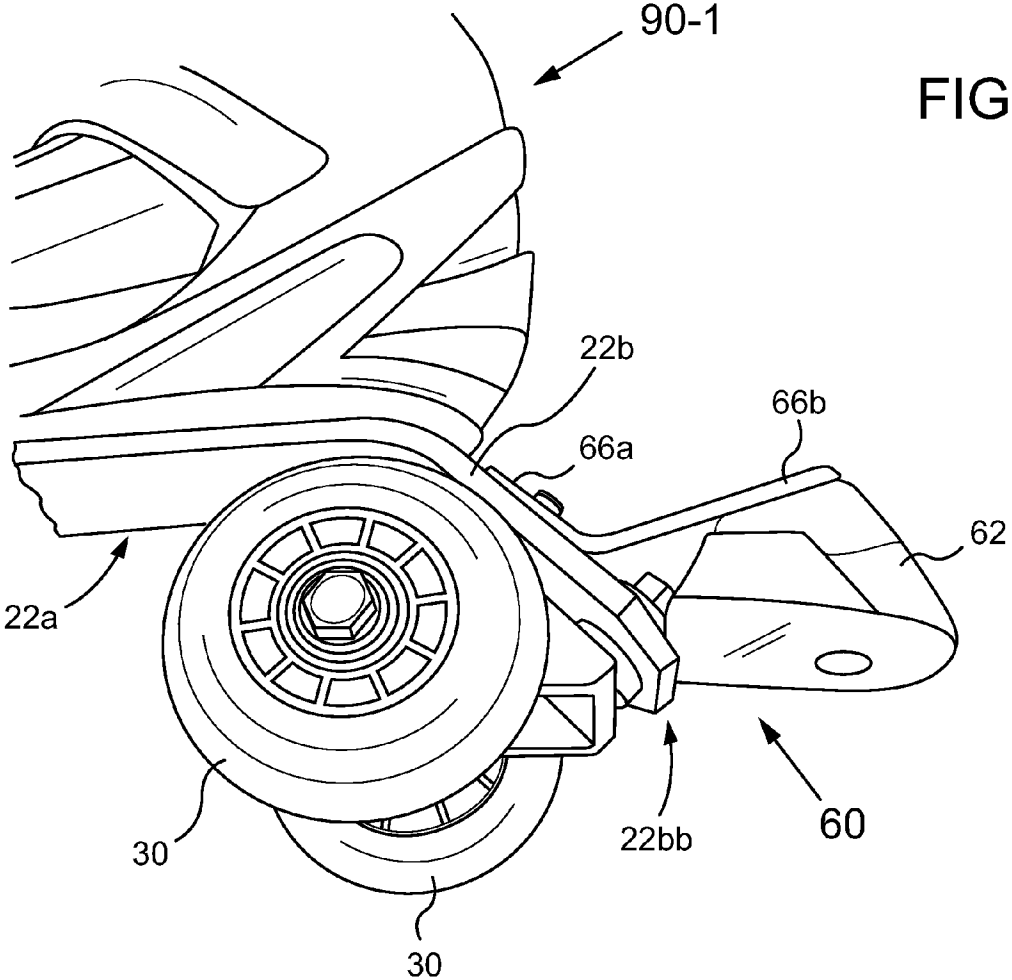
FIG. 10 provides an enlarged view of a rear friction brake structure that is employable with the depicted embodiments of the invention, explicitly depicted with the embodiment of FIGS. 9A and 9B.

Further, the roller wheels 30 of the presently described embodiments of the invention may be replaced by studded wheels or alternately 'ice blades' (neither illustrated herein), or other ground contacting members. In addition, other possible accessory structures may be included with the present invention. For example, as shown in the FIG. 10 depiction of the boot embodiment 90-1, a friction brake 60 may be included. As depicted, a brake mounting bracket 66 may be included having a first portion 66*a* and an second bracket portion 66*b*. As illustrated, the first portion 66*a* may be fixed to the downwardly angled portion 22*b*, while the ground contacting braking portion 62 may be best fixed to the second bracket portion 66*b*. Yet other accessory portions may be provided, including reflectors, training and or safely wheels, etc.

As such, the foregoing descriptions of the specific embodiments of the present invention have been provided for the purposes of illustration, description, and enablement. They are not intended to be exhaustive or to limit the invention to the specific forms disclosed and or illustrated. Obviously numerous modifications and alterations are possible in light of the above teachings, and it is fully intended to claim all modifications and variations that fall within the scope of the appended claims provided hereinafter.

What is claimed is:

1. A roller wheel assembly, comprising:

a) a support member having at least a first upper portion and a second downwardly angled portion, wherein the first upper portion is structured for enabling a coupling of the roller wheel assembly to an includable foot contacting top member;

b) wherein the second downwardly angled portion is structured having a through-bore;

c) a steering related structure, having a bearing-based rotatable coupling employing the through-bore provided in the downwardly angled portion, such that a side-to-side tilting of the first upper portion of the support member, with respect to a ground surface, enables course altering steering adjustments to be made based on the direction of the tilting utilized;

d) wherein the bearing based rotatable coupling includes at least two axially aligned bearings, with each bearing located on an opposing side of the downwardly angled portion of the support member and seated within an opposing counter bore formed on the opposing sides of the downwardly angled portion, such that the bearings are axially aligned with the through-bore;

e) a roller wheel support structure rotatably coupled to the downwardly angled portion of the support member by way of the bearing-based rotatable coupling;

f) with an axis of rotation of the bearing-based rotatable coupling also downwardly angled for contributing to the enhanced tilting and steering capability of the roller wheel assembly;

g) at least two spaced roller wheels which are substantially axially aligned along a common rolling axis, and rollably mounted to side walls of the roller wheel support structure; and h) a capped center shaft that passes through:

i) the through-bore;

ii) a center of each axially aligned bearing; and iii) a threaded hole provided in a transverse wall of the roller wheel support structure.

2. The roller wheel assembly in accordance with claim 1, wherein the center shaft is oriented at a selected angle with respect to the first upper portion of the support member, with the selected angle of the center shaft being a complementary angle of the downward angle of the downwardly angled portion, with the downward angle of the downwardly angled portion in the range of 40 to 50 degrees with respect to at least one of:

a) the first upper portion of the support member; and b) a ground surface upon which the roller wheel assembly rolls.

3. The roller wheel assembly in accordance with claim 2, wherein each included bearing is installed within an opposing counter bore and seated upon opposing sides of a centered bearing seat formed by the opposing counter bores, with the bearing seat structured having an inner diameter establishing an opening that is both:

a) greater than or substantially equal to the diameter of the center shaft passing there through; and b) less than the diameter of the counter bore.

4. A roller wheel assembly, comprising:

a) a support member having at least a first upper portion and a second flattened downwardly angled portion, wherein the first upper portion is structured for enabling a coupling of the roller wheel assembly to an includable foot contacting top member;

b) wherein the second downwardly angled portion is structured having a through-bore;

c) a steering related structure, including a bearing-based rotatable coupling having two axially aligned bearings, with each bearing located on an opposing side of the flattened downwardly angled portion of the support member and seated within an opposing counter bore formed on the opposing sides of the downwardly angled portion, with the steering related structure further employing the through-bore provided in the downwardly angled portion, such that a side-to-side tilting of the first upper portion of the support member, with respect to a ground surface, enables course altering steering adjustments to be made based on the direction of the tilting utilized;

d) a roller wheel support structure rotatably coupled to the downwardly angled portion of the support member by way of the bearing-based rotatable coupling;

e) with an axis of rotation of the bearing-based rotatable coupling also downwardly angled for contributing to the enhanced tilting and steering capability of the roller wheel assembly;

f) at least two spaced roller wheels which are substantially axially aligned along a common rolling axis, and rollably mounted to side walls of the roller wheel support structure; and g) wherein the roller wheel support structure includes:

i) a transverse wall having a threaded-bore established to accommodate the passage of the center shaft of the bearing-based rotatable coupling; and ii) two spaced side walls, which are substantially orthogonal to the transverse wall, with a first end of each side wall fixed to the transverse wall at opposite ends of the transverse wall.

5. The roller wheel assembly in accordance with claim 4, wherein the location of the rolling axis of the axially aligned and spaced roller wheels is adjustable by way of a plurality of spaced and substantially aligned mounting holes, which are located upon the side walls of the roller wheel support structure.

6. The roller wheel assembly in accordance with claim 5, wherein the mounting holes are provided as threaded holes passing through the side walls of the roller wheel support structure.

7. The roller wheel assembly in accordance with claim 5, wherein the bearing-based rotatable coupling and the roller wheel support structure are each structured such that the roller wheel support structure may be rotated 180 degrees for placing the roller wheel assembly in one of either:

a) a first low rolling position, wherein the plurality of spaced and substantially aligned mounting holes are arranged to be substantially horizontally spaced, thereby enabling an adjusting of the roller wheel mounting and rolling locations in a forward and back manner; and b) a second high rolling position, wherein the plurality of spaced and substantially aligned mounting holes are arranged to be substantially vertically spaced, thereby enabling an adjusting of the roller wheel mounting and rolling locations in an up and down manner.

8. The roller wheel assembly in accordance with claim 7, further including a bias return spring having a first end and a second end, wherein:

a) the first end of the bias return spring coupled to the support member and a second end of the bias return spring coupled to the transverse wall;

b) with the bias return spring included for biasing and aiding in a returning of the roller wheel support structure to a straight steering position.

9. The roller wheel assembly in accordance with claim 8, wherein the 180 degree rotating of the roller wheel support structure is enabled following at least one of:

a) releasing of one end of the return bias spring; and b) adjusting of at least one steering stop post.

10. The roller wheel assembly in accordance with claim 4, wherein the upper support portion of the support members of two included roller wheel assemblies are provided as modified upper support portions being one of:

a) joined by a center coupling structure;

b) formed by a rigid, flattened, and elongated foot contacting member;

c) formed of an elongated substantially flattened center member, having two downwardly angled ends, with each end of the substantially flattened center member providing fully each upper support member portion and each downwardly angled portion.

11. The roller wheel assembly in accordance with claim 10, wherein each roller wheel included in the roller wheel assembly remains substantially in contact with the ground surface even when fully tilting the upper support portion of the support member with respect to the ground surface, resulting in a maximum amount of steering and turning supported by the roller wheel assembly.

12. A roller wheel platform, comprising:

a) a plurality of roller wheel assemblies, with each roller wheel assembly including:

i) a support member having at least a first tiltable upper portion and a substantially flattened second downwardly angled portion, with the second downwardly angled portion structured having a through-bore proximate to an end of the second downwardly angled portion;

ii) a roller wheel support structure rotatably coupled to the downwardly angled portion of the support member;

iii) a steering related structure, including a rotatable coupling employing the through-bore provided in the downwardly angled portion for rotatably coupling the downwardly angled portion and the roller wheel support structure, such that a side-to-side tilting of the first upper portions of each support member, with respect to a ground surface, enables an angling of the roller wheel support structure causing a steering in the direction of the tilting;

iv) the roller wheel support structure including a transverse wall and two side walls orthogonally and rigidly coupled to ends of the transverse wall; and v) at least two spaced roller wheels which are substantially axially aligned establishing a common rolling axis, with each roller wheel rollably mounted to a side wall of the roller wheel support structure;

b) wherein the first upper portion of each included roller wheel assembly is rigidly coupled by a center coupling structure at opposite ends of the center coupling structure.

13. The roller wheel platform in accordance with claim 12, wherein the center coupling structure is provided by at least one of:

a) a flattened and elongated foot contacting member, formed of a rigid flattened material;

b) an elongated substantially flattened center member, having two ends, with each end of the flattened center member providing each support member portion and the downwardly angled portion thereof.

14. The roller wheel platform in accordance with claim 13, wherein the included steering related bearing-based rotatable coupling comprises:

a) at least two axially aligned bearings, with each bearing located on an opposing side of a flattened downwardly angled portion of the support member, which are axially aligned with the through-bore; and b) a capped center shaft that passes through each of the through-bore, a center of each bearing, and a bore within the transverse wall of the roller wheel support structure, with the capped center shaft establishing a steering related axis of rotation of the bearing-based rotatable coupling.

15. The roller wheel platform in accordance with claim 14, wherein each included bearing is further seated within a recess established by an opposing counter bore formed within each opposing side of the downwardly angled portion.

16. The roller wheel platform in accordance with claim 12, wherein the location of the rolling axis of the axially aligned and spaced roller wheels is adjustable by way of a plurality of spaced mounting holes, which are located upon the side walls of the roller wheel support structure.

17. The roller wheel platform in accordance with claim 16, wherein the bearing-based rotatable coupling and the roller wheel support structure are each structured such that roller wheel support structure may be rotated 180 degrees for placing the roller wheel assembly in one of either:

a) a first low rolling position, wherein the plurality of spaced and substantially aligned mounting holes are arranged to be substantially horizontally spaced, thereby enabling an adjusting of the roller wheel locations in a forward and back manner;

b) a second high rolling position, wherein the plurality of spaced and substantially aligned mounting holes are arranged to be substantially vertically spaced, thereby enabling an adjusting of the roller wheel locations in an up and down manner.

* * * * *